US009136043B2

(12) United States Patent
Brown et al.

(10) Patent No.: US 9,136,043 B2
(45) Date of Patent: Sep. 15, 2015

(54) CABLE WITH BARRIER LAYER

(75) Inventors: Scott M. Brown, Independence, KY (US); David P. Camp, II, Florence, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 440 days.

(21) Appl. No.: 13/246,269

(22) Filed: Sep. 27, 2011

(65) Prior Publication Data

US 2012/0080211 A1 Apr. 5, 2012

Related U.S. Application Data

(60) Provisional application No. 61/390,021, filed on Oct. 5, 2010, provisional application No. 61/393,606, filed on Oct. 15, 2010.

(51) Int. Cl.
*H01B 11/06* (2006.01)

(52) U.S. Cl.
CPC ..... *H01B 11/06* (2013.01)

(58) Field of Classification Search
USPC ..... 174/110 R, 113 R, 113 C, 115, 116, 174/120 R, 120 SR
See application file for complete search history.

(56) References Cited

U.S. PATENT DOCUMENTS

| | | | | |
|---|---|---|---|---|
| 3,312,774 | A | | 4/1967 | Drinko et al. |
| 3,546,357 | A | | 12/1970 | Windeler et al. |
| 3,576,387 | A | | 4/1971 | Derby |
| 4,129,841 | A | | 12/1978 | Hildebrand et al. |
| 4,423,306 | A | | 12/1983 | Fox |
| 4,486,252 | A | | 12/1984 | Lloyd |
| 4,773,976 | A | * | 9/1988 | Vexler ..... 156/51 |
| 4,871,883 | A | | 10/1989 | Guiol |
| 5,106,538 | A | | 4/1992 | Barma et al. |
| 5,106,540 | A | | 4/1992 | Barma et al. |
| 5,171,938 | A | | 12/1992 | Katsumata et al. |
| 5,212,350 | A | | 5/1993 | Gebs |
| 5,473,336 | A | | 12/1995 | Harman et al. |
| 5,475,185 | A | | 12/1995 | Tokarsky |
| 5,477,011 | A | | 12/1995 | Singles et al. |
| 5,554,236 | A | | 9/1996 | Singles et al. |
| 5,929,138 | A | | 7/1999 | Mercer et al. |
| 5,946,798 | A | | 9/1999 | Buluschek |

(Continued)

FOREIGN PATENT DOCUMENTS

| | | |
|---|---|---|
| CN | 101286384 | 10/2008 |
| DE | 19531065 A1 | 2/1997 |

(Continued)

OTHER PUBLICATIONS

Li et al. "Conductive Coating Formulations with Low Silver Content", 2007 Electronics Components and Technology Conference, IEEE, p. 494-500.

(Continued)

*Primary Examiner* — William H Mayo, III
(74) *Attorney, Agent, or Firm* — Ulmer & Berne LLP

(57) ABSTRACT

A cable that has a cable core which includes a plurality of pairs of insulated conductors, a barrier layer surrounding at least one pair of the insulated conductors, and at least one shielding layer that is provided between the plurality of pairs of insulated conductors. The barrier layer may be non-conductive and the shielding layer may be conductive.

22 Claims, 3 Drawing Sheets

(56) References Cited

U.S. PATENT DOCUMENTS

| | | | | |
|---|---|---|---|---|
| 5,956,445 | A | 9/1999 | Deitz, Sr. et al. | |
| 6,211,459 | B1 * | 4/2001 | O'Groske et al. | 174/36 |
| 6,288,340 | B1 * | 9/2001 | Arnould | 174/113 R |
| 6,384,326 | B1 | 5/2002 | McFadden et al. | |
| 6,484,392 | B1 | 11/2002 | Okada | |
| 6,566,606 | B1 * | 5/2003 | Hazy et al. | 174/113 R |
| 6,686,537 | B1 | 2/2004 | Gareis et al. | |
| 6,697,248 | B1 | 2/2004 | Luch | |
| 6,770,820 | B2 | 8/2004 | Sakurai et al. | |
| 7,120,005 | B1 | 10/2006 | Luch | |
| 7,332,676 | B2 * | 2/2008 | Sparrowhawk | 174/102 R |
| 7,637,776 | B2 | 12/2009 | McNutt et al. | |
| 7,763,805 | B2 | 7/2010 | Stutzman | |
| 2001/0040042 | A1 * | 11/2001 | Stipes | 174/113 R |
| 2003/0097064 | A1 | 5/2003 | Talpade et al. | |
| 2003/0111241 | A1 | 6/2003 | Bahlmann et al. | |
| 2004/0026113 | A1 | 2/2004 | Bahlmann et al. | |
| 2004/0035603 | A1 | 2/2004 | Clark et al. | |
| 2004/0055781 | A1 | 3/2004 | Cornibert et al. | |
| 2005/0006126 | A1 | 1/2005 | Aisenbrey | |
| 2005/0029000 | A1 | 2/2005 | Aisenbrey | |
| 2005/0045358 | A1 | 3/2005 | Arnold | |
| 2005/0077066 | A1 | 4/2005 | Stipes | |
| 2006/0048961 | A1 * | 3/2006 | Pfeiler et al. | 174/36 |
| 2006/0272856 | A1 | 12/2006 | Arnold | |
| 2006/0272857 | A1 | 12/2006 | Arnold | |
| 2007/0037419 | A1 | 2/2007 | Sparrowhawk | |
| 2008/0072106 | A1 | 3/2008 | Hamilton | |
| 2008/0251276 | A1 | 10/2008 | Clark et al. | |
| 2008/0257599 | A1 | 10/2008 | Matsushita et al. | |
| 2008/0283290 | A1 | 11/2008 | Niino et al. | |
| 2009/0173511 | A1 | 7/2009 | Smith et al. | |
| 2010/0000780 | A1 | 1/2010 | Zhu et al. | |
| 2010/0096179 | A1 | 4/2010 | Sparrowhawk et al. | |

FOREIGN PATENT DOCUMENTS

| | | | | | |
|---|---|---|---|---|---|
| DE | 0915486 | A | * | 11/1997 | H01B 11/08 |
| DE | 29719866 | U1 | | 12/1997 | |
| EP | 0915486 | A1 | * | 11/1998 | H01B 11/08 |
| EP | 1469485 | A2 | | 10/2004 | |
| GB | 2084385 | | | 9/1980 | |
| GB | 2432963 | | | 7/2010 | |
| JP | 64-007411 | | * | 11/1989 | H01B 11/06 |
| JP | 3-216914 | A | * | 9/1991 | H01B 11/04 |
| WO | WO-2006105166 | A2 | | 10/2006 | |
| WO | WO-2007149191 | A1 | | 12/2007 | |
| WO | WO-2008/096348 | | | 8/2008 | |
| WO | 2008157175 | A1 | | 12/2008 | |

OTHER PUBLICATIONS

Donald M. Bigg, "Mechanical, Thermal, and Electrical Properties of Metal Filber-Filled Polymer Composites", Polymer Engineering & Science, vol. 19, No. 16 (1979) pp. 1188-1192.

Wozniak, Doris Anna; European Search Report and European Search Opinion, issued in European Patent Application No. 11184043.5; dated Jan. 13, 2014; 13 pages.

Wikipedia, the free encyclopedia; "Category 5 cable" Jan. 19, 2010, as cited in European Search Report and retrieved from http://web.archive.org/web/20100119040020/http://en.wikipedia.org/wiki/Cat_5#cite_note-drakacom_cat5-10; 4 pages.

Sanchez Vargas, Hector Javier; Office Action issued in Mexican Patent Application No. MX/a/2011/010508; dated Feb. 7, 2014; 5 pages including machine translation.

Tang, Thomas; Office Action issued in Canadian Patent Application No. 2,754,443; dated Jun. 16, 2014; 3 pages.

* cited by examiner

CABLE WITH BARRIER LAYER

RELATED APPLICATION

This application claims priority under 35 U.S.C. §119 to U.S. Provisional Application Ser. Nos. 61/390,021 and 61/393,606, filed Oct. 5, 2010 and Oct. 15, 2010, respectfully, both entitled Cable With Barrier Layer, the subject matter of each of which is herein incorporated by reference.

FIELD OF THE INVENTION

The present invention generally relates to a cable that uses one or more barrier layers applied over cable elements that require separation and isolation, such as conductor pairs and the like.

BACKGROUND OF THE INVENTION

A conventional communication cable typically includes a number of insulated conductors that are twisted together in pairs and surrounded by an outer jacket. The insulated conductors often have a large diameter due to the thickness of the insulation for reducing or correcting the affect of the cable's shield on impedance. Also, a large crossweb separator, tape separator or plurality of tape separators are usually added to the cable core to provide the required electrical isolation between the wire pairs to reduce interference or crosstalk. Crosstalk often occurs because of electromagnetic coupling between the twisted pairs within the cable or other components in the cable. Conventional cables also often require tight twist lays on the individual lays of the conductor pairs to reduce pair-to-pair noise coupling. Such use of large insulated conductors, large separators, and tight pair lays, however, significantly increases the overall size of the cable.

SUMMARY OF THE INVENTION

Accordingly, the present invention provides a cable that comprises a cable core which includes a plurality of pairs of insulated conductors, a barrier layer surrounding at least one pair of the insulated conductors, and at least one shielding layer that is provided between the plurality of pairs of insulated conductors. The barrier layer may be non-conductive and the shielding layer may be conductive.

The present invention also provides a cable that comprises a cable core that includes at least first and second of pairs of insulated conductors, a barrier layer that surrounds each of the first and second of pairs of insulated conductors, and at least one of the first and second pairs of insulated conductors has a shielding layer provided on the barrier layer. The barrier layers may be non-conductive and the shielding layer may be conductive.

The present invention also provides a cable that comprises a cable core that includes a plurality of pairs of insulated conductors, and a barrier layer that surrounds at least one of the plurality of pairs of insulated conductors. The barrier layer may be formed of a non-conductive material with conductive particles suspended within the non-conductive barrier layer.

The present invention may further provide a cable that comprises a cable core that includes a plurality of pairs of insulated conductors and a barrier layer surrounding at least one of the plurality of pairs of insulated conductors. The barrier layer may be formed of a non-conductive material. A shielding layer formed of a non-conductive layer with conductive particles suspended within the shielding layer surrounds the barrier layer.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1, 2A, 2B, 3 and 4, a cable according to exemplary embodiments of the present invention generally includes a barrier layer or jacket that surrounds the pairs of insulated conductors of the cable. A shielding layer may also be provided between the pairs that is either disposed on the barrier layer (e.g. shielding layer 130) and/or separate from the barrier layer (e.g. shielding 350). The use of the barrier layer reduces the overall size of the cable for several reasons. One, the insulated conductor size is reduced because the barrier layers may mitigate the effects of the cable's shielding layer on impedance. Thus, the overall thickness of the insulation over the conductors of the pairs may be reduced while maintaining the same nominal impedance and the same diameter of the conductors prior to insulating. Two, the barrier layers increase the physical distance between the pairs of the cable which significantly reduces internal crosstalk emitted from one pair to another, thereby eliminating the need for a bulky separator, such as a crossweb. Third, the shielding of each prospective pair by the barrier layers further reduces internal crosstalk, which then permits longer pair lay lengths to be employed. By decreasing the pair lay length, the helical distance of the signal transmission traveling along the pair is reduced which causes the signal transmission to be less attenuated. This allows the diameter of each conductor within the pair to be reduced. Moreover, the improved shielding due to the barrier layers and reduction of interference allows the cable to accommodate high speeds, such as 40 Gb/s Ethernet applications, with improved performance.

Figure 1:
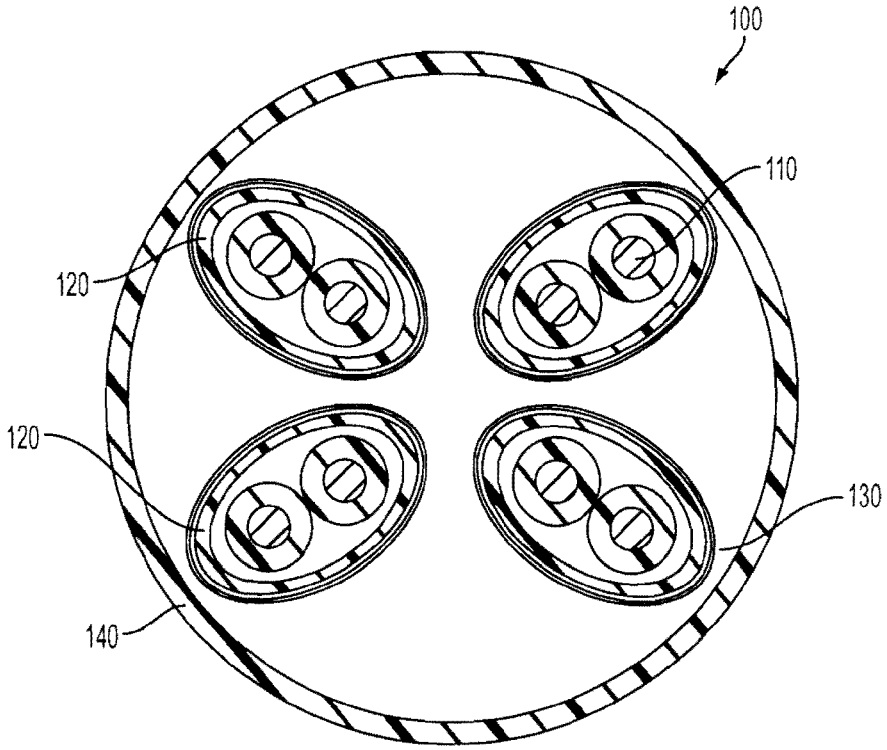
FIG. 1 is a cross-sectional view of a cable in accordance with a first exemplary embodiment of the present invention.

A first exemplary embodiment of the present invention is illustrated in FIG. 1 showing cable 100. The cable 100 generally includes a plurality of pairs 110 of insulated conductors. The conductors of each pair 110 are preferably twisted together. A barrier layer 120 is extruded over each pair 110, thereby isolating the pairs from one another. Each barrier layer 120 completely surrounds a respective pair 110. The thickness of the barrier layer is at least 25%, and preferably about 35%-125% of the thickness of the insulation of the individual conductors of the wire pairs 110 of the cable. For example, the thickness of the barrier layer is preferably 0.0035-0.0125 inches when the insulation thickness around the conductor is 0.0100 inches.

Each barrier layer 120 may be formed of a non-conductive material, such as polypropylene or polyethylene, or a fluoropolymer, such as FEP, ECTFE, MFA, PFA and PTFE. The barrier layer 120 may also be formed of woven or non-woven fiberglass fiber or non-conductive textile fiber. In addition, the barrier layer 120 can be a non-conductive material which includes fibrous filler strands, in particular, woven or non-woven strands of fiberglass. Such fiberglass strands can be added to the dielectric to improve the flame and smoke properties of the tube. Fiberglass is typically neutral when compared to the flame and smoke properties of dielectric materials, such as fluoropolymers and olefins. The neutral fiberglass strands displace some of the dielectric material of the barrier layer. Also, the barrier layer 120 could include more than one type of non-conductive material embedded in the layer and/or multiple layers of different non-conductive materials. Use of different dielectric materials, such as olefins and fluoropolymers, also helps to balance the smoke and flame properties of the cable to achieve compliance with various fire safety requirements for commercial building installations, such as the NFPA 262 requirements for plenum rated cables and UL 1666 for riser rated cables.

A shielding layer 130 is preferably provided over each barrier layer 120. The shielding layer 130 may be formed of a conductive material. The shielding layer 130 may be foil, for example, that is wrapped around each barrier layer 120 of the pairs. The foil may be provided with a backing to facilitate application of the shielding layers 130 to the barrier layers 120. As an alternative to a foil layer, the shielding layers 130 may be a coating applied to the outer surfaces of the barrier layers 120 of the pairs 110. For example, the coating or shielding layer may be applied by screen or inkjet printing. The shielding layer 130 may also be applied by spray, wipe on, pressure, electrostatic deposition, chemical deposition and thermal spray techniques, which coat or embed a conductive layer of conductive particles into the outer surface of the barrier layer 120. This conductive particle application or deposition may be covered with an additional layer of acrylic, enamel or polymer adhesives to further bind the particles. The shielding layer 130, in yet another alternative, may be an extruded layer, that contains conductive particles on the outer surface of the barrier layers 120 of the pairs 110.

In accordance with a preferred embodiment, the shielding layer 130 may be discontinuous. That is, the shielding layer 130 may be formed of conductive segments disposed on a substrate as disclosed in commonly owned, co-pending U.S. application Ser. No. 13/246,207 entitled Cable Barrier Layer With Shielding Segments, filed concurrently herewith, the subject matter of which is herein incorporated by reference. The shielding layer 130 may also be formed of conductive particles provided in high concentration in segments of the substrate or an extruded layer containing conductive particles which is further processed to create segments. Alternatively, the shielding layer 130 may be continuous.

The plurality of pairs 110 form the cable's core. An overall jacket 140 surrounds the core of pairs. Because the barrier layers 120 more effectively isolate and shield the conductor pairs 110, the wall thickness of the jacket 140 may be a standard thickness to obtain applicable performance and maintain a smaller overall cable diameter. That is, unlike conventional cables, the thickness of the jacket 140 does not need to be increased to create physical cable separation to lessen alien crosstalk between adjacent cables.

Figure 2A:
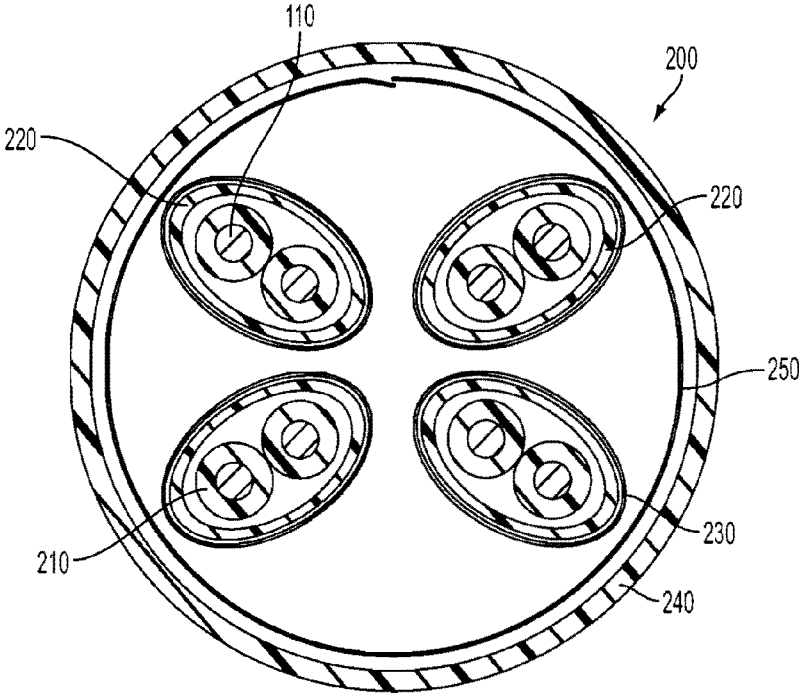
FIGS. 2A and 2B are each a cross-sectional view of a cable in accordance with a second exemplary embodiment of the present invention.
Figure 2B:
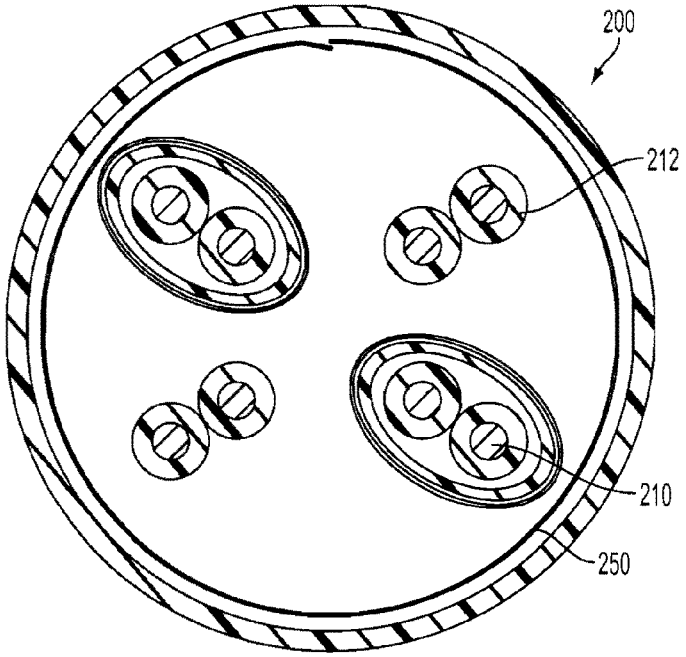

As seen in FIG. 2A, a cable 200 according to a second exemplary embodiment of the present invention is similar to the cable 100 of the first embodiment, except that an overall shielding 250 is wrapped around the core of cable pairs 110. Like cable 100, the cable 200 of the second embodiment includes a plurality of pairs of insulated conductors 110. Each pair preferably includes a barrier layer 220 similar to the barrier layer 120 of the first embodiment. At least one or more pairs 210 of the insulated conductors includes a shielding layer 230 over the barrier layer 220 as in the first embodiment, as seen in FIG. 2A. Alternatively, one or more of the remaining pairs of insulated conductors may not include a shielding layer 230. The overall shielding 250 is provided around all of the pairs forming the core of the cable. This overall shielding 250 is preferably discontinuous along the length of the cable. The overall shielding 250 may alternatively be continuous. An overall jacket 240 surrounds the overall shielding layer 250 and the cable's core of pairs. Although it is preferable that all of the pairs 110 of the cable 200 include a barrier layer 220, with or without the shielding layer 230, one or more of the pairs 212 may not have a barrier layer, as seen in FIG. 2B.

Figure 3:
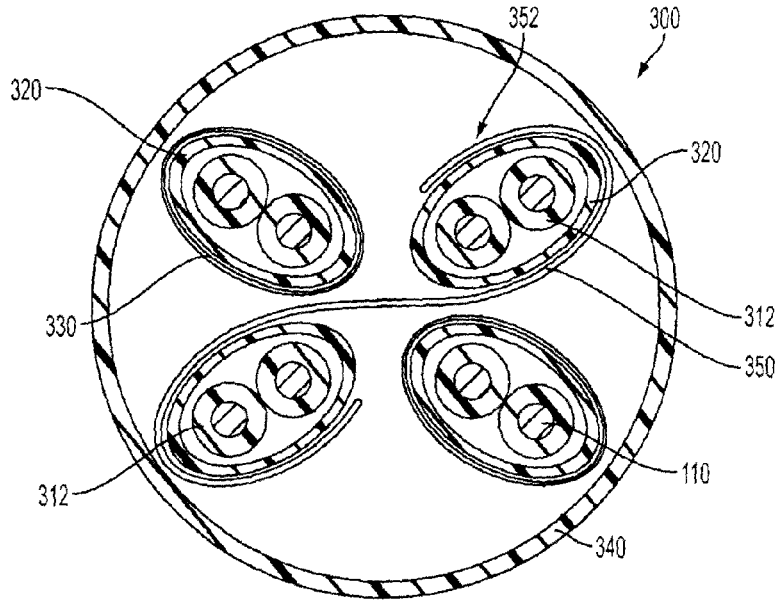
FIG. 3 is a cross-sectional view of a cable in accordance with a third exemplary embodiment of the present invention.

FIG. 3 illustrates a third exemplary embodiment of the present invention. Cable 300 is similar to cable 200 of the second embodiment, except that the overall shielding is provided between the pairs. More specifically, the cable 300 includes one or more pairs 110 that has both a barrier layer 320 and a shielding layer 330, like in the first and second embodiments. Cable 300 also has one or more pairs 312 that only includes a barrier layer 320, like in the second embodiment. A shielding 350 may extend between the pairs 110 and 312, as seen in FIG. 3. Preferably, end portions 352 of the shielding 350 at least partially wrap around the pairs 312, which do not include a shielding layer 330. An overall jacket 340 surrounds the core of pairs and the second shielding 350 therebetween.

Figure 4:
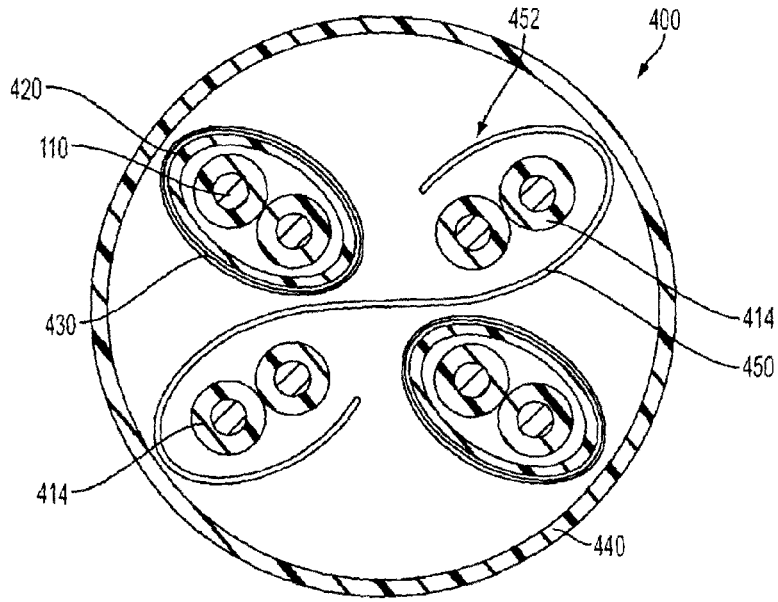
FIG. 4 is a cross-sectional view of a cable in accordance with a fourth exemplary embodiment of the present invention.

As seen in FIG. 4, a cable 400 according to a fourth embodiment of the present invention is similar to cable 300 of the third embodiment, except that one or more pairs does not include a barrier layer or shielding layer. In particular, the cable 400 includes one or more pairs 110 that has both a barrier layer 420 and a shielding layer 430, similar to the embodiments above. The cable 400 also has one or more pairs 414 that has neither a barrier layer nor a shielding layer. Instead, a shielding layer 450 is provided between the pairs 110 and 414, as seen in FIG. 4. Like in the third embodiment, end portions 452 of the shielding 450 preferably partially wrap around the pairs 414. An overall jacket 440 surrounds the pairs 110 and 414 and the second shielding 450 therebetween.

Although the barrier layers of the exemplary embodiments of the present invention are preferably extruded over the conductor pairs, the barrier layers may be formed as a split tube as disclosed in commonly owned co-pending U.S. application Ser. No. 13/227,125, entitled Cable With A Split Tube and Method For Making The Same, filed on Sep. 7, 2011, the subject matter of which is hereby incorporated by reference.

As an alternative to adding the shielding layer onto the barrier layer as discussed above, conductive material or particles may be suspended within the non-conductive material of the barrier layer or disposed on an outer surface thereof, as disclosed in commonly owned co-pending application Ser. No. 13/246,183 entitled Shielding For Communication Cables Using Conductive Particles, filed concurrently herewith, the subject matter of which is herein incorporated by reference. That would create a conductive or semi-conductive barrier layer that provides shielding without the added coating or shielding layer. For example, the barrier layer may be formed of a dielectric material, such as an olefin, like polypropylene or polyethylene, or a fluoropolymer, like FEP, ECTFE, MFA, PFA and PTFE, that contains conductive particles such as, aluminum, copper, iron oxides, nickel, zinc, silver and carbon nano-fibers.

While particular embodiments have been chosen to illustrate the invention, it will be understood by those skilled in the art that various changes and modifications can be made therein without departing from the scope of the invention as defined in the appended claims. For example, although the cables of the exemplary embodiment are shown as having four conductor pairs, any number of pairs may be used. Moreover, the present invention contemplates that any combination of pairs may be used with or without barrier layers and shielding layers.

What is claimed is:

1. A cable comprising:

a cable core comprising:

first and second insulated pairs of conductors, each conductor of said first and second insulated pairs of conductors being surrounded by an insulation layer;

a barrier layer surrounding said first insulated pair of conductors, said barrier layer being non-conductive; and a shielding layer having a pair of opposing edges and a central portion disposed between said opposing edges, said shielding layer surrounding said second insulated pair of conductors, said shielding layer being conductive and separate from said barrier layer; and an outer jacket surrounding the cable core, wherein:

said central portion of said shielding layer is routed between said first insulated pair of conductors and said second insulated pair of conductors;

said first insulated pair of conductors is interposed between one of said opposing edges and said central portion; and said barrier layer surrounding said first insulated pair of conductors contacts the outer jacket.

2. A cable according to claim 1, wherein said barrier layer has a thickness that is at least 0.0035 inches.

3. A cable according to claim 1, wherein said shielding layer is discontinuous.

4. A cable according to claim 1, wherein said shielding layer is foil.

5. A cable according to claim 1, wherein said barrier layer is formed of one or more olefins or one or more fluoropolymers.

6. A cable according to claim 1, wherein said barrier layer is formed of one of an olefin, fiberglass, a fluoropolymer filled with a fiberglass fiber, and a non-conductive textile fiber.

7. A cable according to claim 1, wherein said barrier layer comprises one of more layers of olefins or fluoropolymers.

8. A cable comprising:

a cable core comprising:

first and second insulated pairs of conductors, each conductor of said first and second insulated pairs of conductors being surrounded by an insulation layer;

a barrier layer surrounding said first insulated pair of conductors, said barrier layer being non-conductive; and a shielding layer having a pair of opposing edges and a central portion disposed between said opposing edges, said shielding layer provided on said second insulated pair of conductors, said shielding layer being conductive and separate from said barrier layer; and an outer jacket surrounding the cable core, wherein:

said central portion of said shielding layer is routed between said first insulated pair of conductors and said second insulated pair of conductors;

said first insulated pair of conductors is interposed between one of said opposing edges and said central portion; and said barrier layer surrounding said first pair of insulated conductors contacts the outer jacket.

9. A cable according to claim 8, wherein said shielding layer is discontinuous.

10. A cable according to claim 8, wherein said shielding layer is foil.

11. A cable according to claim 8, wherein each barrier layer has a thickness that is at least 25% of a thickness of the insulation of each conductor.

12. A cable according to claim 8, wherein a thickness of each barrier layer is at least 0.0035 inches.

13. A cable comprising:

a cable core comprising:

first and second insulated pairs of conductors, each conductor of said first and second insulated pairs of conductors being surrounded by an insulation layer;

a barrier layer surrounding said first insulated pair of conductors, said barrier layer being formed of a non-conductive material having conductive particles disposed on an outer surface of said barrier layer;

a shielding layer having a pair of opposing edges and a central portion disposed between said opposing edges, said shielding layer surrounding said second insulated pair of conductors, said shielding layer being conductive and separate from said barrier layer; and an outer jacket surrounding the cable core, wherein:

said central portion of said shielding layer is routed between said first insulated pair of conductors and said second insulated pair of conductors;

said first insulated pair of conductors is interposed between one of said opposing edges and said central portion; and said barrier layer surrounding said first insulated pair of conductors contacts the outer jacket.

14. A cable according to claim 13, wherein said barrier layer is formed of an olefin or fluoropolymer with conductive particles of one or more of aluminum, copper, iron oxides, nickel, zinc, silver or carbon nano-fibers suspended in said barrier layer.

15. A cable according to claim 13, wherein said barrier layer is formed into discontinuous segments.

16. A cable according to claim 13, wherein said barrier layer has a thickness that is at least 35% of the thickness of the insulation of each conductor.

17. A cable comprising:

a cable core comprising:

first and second insulated pairs of conductors, each conductor of said first and second insulated pairs of conductors being surrounded by an insulation layer; and a shielding layer having a pair of opposing edges and a central portion disposed between said opposing edges, said shielding layer being non-conductive and surrounding said second insulated pair of conductors; and an outer jacket surrounding the cable core, wherein:

said central portion of said shielding layer is routed between said first insulated pair of conductors and said second insulated pair of conductors; and said first insulated pair of conductors is interposed between one of said opposing edges and said central portion.

18. A cable according to claim 17 further comprising a barrier layer surrounding said first insulated pair of conductors, wherein said barrier layer is an olefin or a fluoropolymer; and said shielding layer is an olefin or fluoropolymer with conductive particles of one or more of aluminum, copper, iron oxides, nickel, zinc, silver or carbon nano-fibers suspended in the shielding layer.

19. A cable according to claim 17, wherein said shielding layer is formed into discontinuous segments.

20. A cable according to claim 17 further comprising a barrier layer surrounding said first insulated pair of conductors, wherein said barrier layer has a thickness that is at least 35% of the thickness of the insulation of each conductor.

21. A cable according to claim 17 further comprising a barrier layer surrounding said first insulated pair of conductors, said barrier layer being formed of a non-conductive material and contacting the outer jacket.

22. A cable according to claim 17 wherein the shielding layer comprises a non-conductive layer with conductive particles disposed on an outer surface.

* * * * *